US008349154B2

(12) United States Patent
Lu et al.

(10) Patent No.: US 8,349,154 B2
(45) Date of Patent: Jan. 8, 2013

(54) SURFACE MODIFIED ELECTRODES FOR ER FLUIDS

(75) Inventors: Kunquan Lu, Beijing (CN); Rong Shen, Beijing (CN); Xuezhao Wang, Beijing (CN)

(73) Assignee: Institute of Physics, Chinese Academy of Sciences, Beijing (CN)

( * ) Notice: Subject to any disclaimer, the term of this patent is extended or adjusted under 35 U.S.C. 154(b) by 131 days.

(21) Appl. No.: 12/304,999

(22) PCT Filed: Jun. 15, 2007

(86) PCT No.: PCT/CN2007/001891

§ 371 (c)(1),
(2), (4) Date: Dec. 15, 2008

(87) PCT Pub. No.: WO2007/147348

PCT Pub. Date: Dec. 27, 2007

(65) Prior Publication Data

US 2009/0136394 A1 May 28, 2009

(30) Foreign Application Priority Data

Jun. 15, 2006 (CN) ..... 2006 1 0012256

(51) Int. Cl.
*C25B 11/04* (2006.01)

(52) U.S. Cl. ..... 204/294; 204/280; 204/164; 204/450; 204/291; 422/186.04; 267/140.11; 267/140.14; 267/219; 428/457; 428/458; 428/459; 428/461; 428/688; 428/68; 188/267

(58) Field of Classification Search ..... 428/457–459, 428/461, 688, 68; 267/140.11, 140.14, 219; 188/267; 204/164, 450, 294, 280, 291; 205/687; 422/186.04
See application file for complete search history.

(56) References Cited

U.S. PATENT DOCUMENTS

| | | | | |
|---|---|---|---|---|
| 4,981,286 | A * | 1/1991 | Kato et al. | 267/140.14 |
| 5,288,535 | A * | 2/1994 | Kanbara et al. | 428/68 |
| 5,810,126 | A * | 9/1998 | Kordonsky et al. | 188/267 |
| 7,137,496 | B2 | 11/2006 | Sheng et al. | |
| 2007/0031694 | A1 * | 2/2007 | Hosonuma et al. | 428/621 |

FOREIGN PATENT DOCUMENTS

| | | | |
|---|---|---|---|
| CN | 1694338 | A | 11/2005 |
| JP | H02-203036 | A | 8/1990 |
| JP | H04-185918 | A | 7/1992 |
| JP | H07-190099 | A | 7/1995 |
| JP | 2000-144165 | A | 5/2000 |

OTHER PUBLICATIONS

Abujdayil, B., et al., "Effects of Coating on the Behavior of Electrorheological Fluids in Torsional Flow," Smart Materials & Structures 6:509-520 (1997).

Abu-Jdayil, B., et al., "Effect of Polymer Coating on the Behavior of an Electro-Rheological Fluid in Slit Flow," www.sciencedirect.com (Nov. 16, 2005).

Abujdayil, B., et al., "Effect of Electrode Morphology on the Behavior of Electrorheological Fluids in Torsional Flow," Journal of Intelligent Material Systems and Structures 13:3-11 (2002).

* cited by examiner

*Primary Examiner* — Bruce Bell
(74) *Attorney, Agent, or Firm* — Manni Li; Mei & Mark LLP

(57) ABSTRACT

The invention relates to modified electrodes for ER fluids prepared by adding a rough, wear-resisting, and low conductive modified layer on the surface of metallic electrodes. The material for the modified layer can be at least one from diamond, alumina, titanium dioxide, carborundum, titanium nitride, nylon, polytetrafluoroethylene, adhesive, and adhesive film. Through the addition of the modified layer, the adhesion of the ER fluid to electrodes is increased so that the shear stress measured near the plates is close to the intrinsic value, which makes the ER fluid applicable, while reducing the leakage current and increasing the breakdown voltage of the ER fluid equipment.

14 Claims, 3 Drawing Sheets

(a) (b)

(a) (b)

(a) (b)

(a) (b)

SURFACE MODIFIED ELECTRODES FOR ER FLUIDS

FIELD OF THE INVENTION

The present invention relates to surface modified electrodes for electrorheological fluids, in particular, surface-modified electrode plates for polar molecule dominated electrorheological fluids.

BACKGROUND OF THE INVENTION

Electrorheological (ER) fluids are novel intelligent material, which are complex fluids comprising dielectric particles mixed with an insulating liquid. Without an external electric field, the ER fluid is in the liquid state; when an external electric field is applied, the shear stress of the ER fluid increases as the electric field increases. When the electric field strength is high enough, the ER fluid may be transformed to a solid-like state. The transformation of the shear stress is reversible, and the response time is within milliseconds. Because of the unique characteristics of the tunable hardness, ER fluids are useful in industry and military fields.

Ordinary metallic electrodes are usually used for the measurement and application of ER fluids as positive and negative electrodes. The conventional ER fluid is based on the polarization interaction between the particles, its shear stress is relatively low, usually no more than 10 kPa, therefore, the ordinary metallic electrodes can basically meet the conditions of the ER fluid interaction and satisfy the requirements for measurement and application of the conventional ER fluid material.

The yield stress of the polar molecule dominated electrorheological (PM-ER) fluid may reach several hundreds kPa or higher, which is tens of times more than that of the conventional ER fluids, and the dynamic shear stress also greatly increases. Usually, ordinary metallic electrodes can not meet the orientation and conditions of interactions required for the polar molecules, and the ER fluid and the surface of the electrode may "slide." Therefore, if ordinary metallic electrodes are used, the shear stress of the ER fluid is much lower than what can be actually achieved, which greatly restrain the application of the PM-ER fluid. The use of the surface roughening of the electrodes may ease the problem of "slide" such that the shear stress as measured may increase about twice, however, the treatment makes the rough surface of the metallic electrodes easier to electrically discharge, and difficult for the application in a high electric field.

DESCRIPTION OF THE INVENTION

The present invention provides surface modified electrodes for ER fluids which avoid the slide between ER fluids and electrodes. The modified electrodes are applied such that not only the measured shear stress of the ER fluids at the electrodes approaches the intrinsic value, but also the leakage current is significantly reduced.

In the surface modified electrodes of the present invention for the ER fluid, a surface modified layer which is rough, wear-resisting, and low conductive is added on the surface of the metallic electrodes to increase the adhesion between the ER fluid and the electrodes, and at the same time, to improve the life span and to decrease the current density.

The material for the modified layer of the surface treated modified electrodes may be inorganic, organic, metal, or a mixture thereof. The material is at least one from the following: diamond, alumina, titanium dioxide, carborundum, titanium nitride, nylon, polytetrafluoroethylene, adhesive, and adhesive film.

The surface modified electrode of the present invention for the ER fluid may be prepared by adding the modified layer on the surface of metallic electrodes by mechanical processing, spraying, chemical depositing, adhesive bonding, plating, sintering, or infiltrating.

The surface modified electrode of the present invention for the ER fluid provides that the configuration of the modified layer is of regular or irregular particle, stripe, or grid. The thickness of the modified layer is in the range of 1 μm to 1 mm, the material of the modified layer occupies between 10% and 100% of the area of the surface of the metallic electrode, the particle size is between 100 nm and 0.5 mm, and the distance between neighboring stripes or grids is between 0.1 mm and 3 mm.

The surface modified electrode of the present invention for the ER fluid, through the addition of the modified layer, increases the adhesion of the ER fluid to electrodes effectively enough to improve the measured shear stress at the electrodes close to the intrinsic value, which makes the application of the ER fluid possible. At the same time, the modified layer reduces the leakage current of the ER fluid object and increases the breakdown voltage of the ER fluid. The modified electrode of the ER fluid may be used as the positive and negative electrodes in the ER device for the application of the ER fluid.

DETAILED EMBODIMENTS

Figure 1:
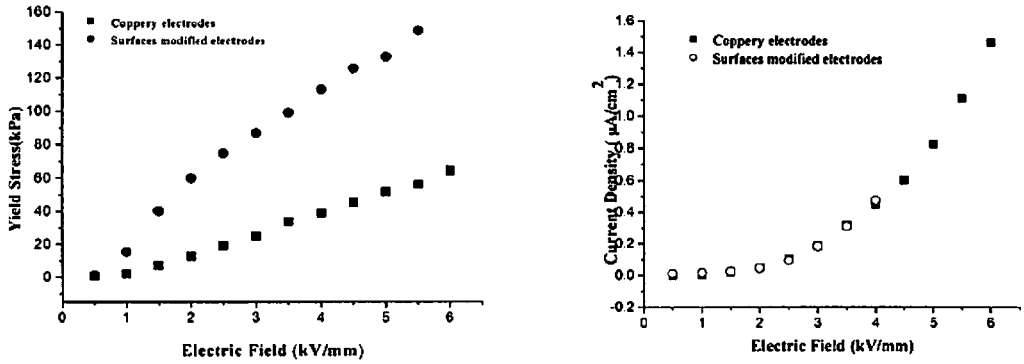
FIG. 1 shows the comparison of the electrorheological properties of an ER fluid with modified electrodes fabricated by gluing titanium dioxide particles on the surfaces of the coppery plates and with rough coppery electrodes.

PREPARATION EXAMPLE 1.

Preparation of Acetamide-Doped Titanium Dioxide Nano-Particle ER Fluid.

The acetamide-doped titanium dioxide particles are prepared by the sol-gel method:

Composition 1: 30 ml $Ti(OC_4H_9)_4$ is dissolved in 210 ml dehydrated ethanol, and the PH value is adjusted to 1-3 by hydrochloric acid solution.

Composition 2: 40 ml deionized water and 150 ml dehydrated ethanol are homogeneously mixed.

Composition 3: 30 g acetamide is dissolved in 20 ml deionized water. With strong stirring, composition 2 is added into composition 1, then composition 3 is added immediately; the mixed solution is stirred continuously to form a colorless transparent gel. The gel is aged at room temperature until some liquid separates out, then, dried to white powder in vacuum at low temperature. After several washings, centrifugation, and filtering, the powder is dried at 50° C. for more than 48 hours and then at 120° C. for 3 hours to obtain the titanium oxide spherical particles with the polar groups of C═O and C—$NH_2$. The size is in the range of 50-100 nm and dielectric constant is about 1000. The polar groups C═O and C—$NH_2$ comprise 20 molar percent of the prepared titanium dioxide nanoparticles.

The prepared titanium dioxide nanoparticles are mixed with 10# silicon oil in a ball grinding mill for more than 3 hours so that the particles are completely dispersed to form the ER fluid. The particles comprise 30% by volume of the total volume.

PREPARATION EXAMPLE 2.

Preparation of the ER Fluid of Calcium Titanate Nanoparticles With the Polar Groups of C═O And O—H.

Preparation of calcium titanate nanoparticles via co-precipitation.

Composition 1: 30 ml titanium tetrachloride is homogenously mixed in dehydrated ethanol at a molar ratio of 1:25.

Composition 2: dehydrated calcium chloride is dissolved in deionized water at 2 mol/l to obtain its aqueous solution.

Compositions 1 and 2 are thoroughly stirred and mixed at 60° C. water bath, and the pH is adjusted to 4 by adding hydrochloric acid to get a mixed solution of 1+2.

Composition 3: oxalic acid is dissolved in deionized water to obtain a solution of 2 mol/l.

Composition 3 is added dropwise into the mixture solution of 1+2, and the volume ratio in the mixture of the 3 compositions is 2:1:2. The precipitation formed from the mixture is aged at 60° C. for 12 hours, washed by deionized water, filtered, dried for more than 120 hours, and again dried at 120° C. for 3 hours to obtain the spherical calcium titanate nanoparticles of a size of 50-100 nm. The amount of polar groups O—H and C═O that are retained in the particles is controlled by the washing time and frequency. The analysis under infrared spectrometry (Type: Digilab FTS3000) confirms that the polar groups O—H and C═O comprise 25 molar percent of the particles, and the dipole moment of the polar groups O—H and C═O is 1.51 deb and 2.3-2.7 deb, respectively.

Calcium titanate particles are mixed with methyl silicon oil having a viscosity of 50# in a ball grinding mill for more than 3 hours so that the particles are completely dispersed to form the ER fluid.

EXAMPLE 1

The surfaces of the electrodes are modified by chemical bonding. Solid $TiO_2$ particles having a size of about 100 nm are bonded to the surfaces of the coppery plates with epoxy resin. The particles comprise 90% of the surface area of the metallic electrode plates, and the thickness is about 10 μm on the surface. The modified plates are used as the positive and negative electrodes of the parallel-plate rheometer to test the yield stress of a $TiO_2$ ER fluid (containing polar molecules). As shown in FIG. 1, the resulted yield stress is increased 1 time over that with rough coppery electrodes (FIG. 1*a*), and the current density with the two kinds of electrodes remains essentially the same (FIG. 1*b*).

EXAMPLE 2

Figure 2:
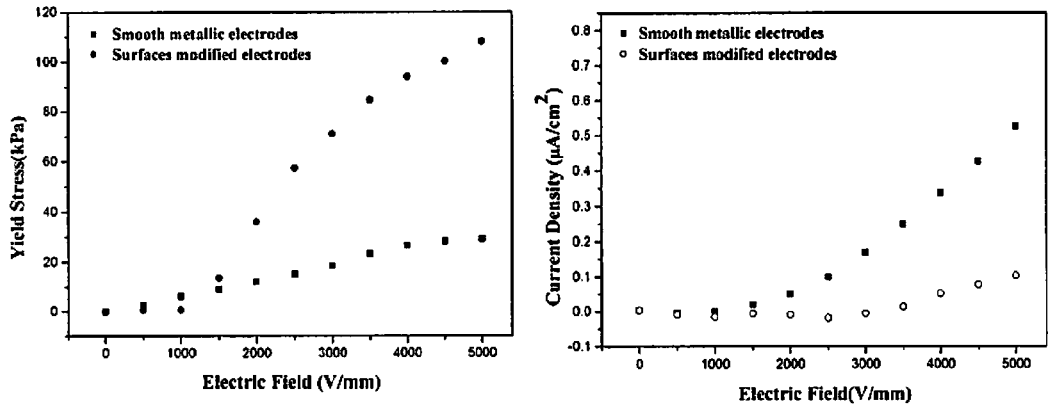
FIG. 2 shows the comparison of the electrorheological properties of an ER fluid with the modified electrodes fabricated by spraying alumina particles on the surfaces of metallic plates and with the smooth metallic electrodes.

The surfaces of the electrodes are modified by surface spraying. Solid $Al_2O_3$ particles having a particle size of about 5 μm are sprayed to the surfaces of the aluminum plates via plasma spraying technique. The thickness of the modified layer is about 10 μm, and the modified layer occupies 100% of the surface area of the metallic electrodes. The modified plates are used as the positive and negative electrodes of the parallel-plate rheometer to test the yield stress of the ER fluid of calcium titanate nanoparticles containing C═O and O—H groups as prepared in the Preparation Example 2. As shown in FIG. 2, the resulted yield stress is increased 4 times over that with smooth metallic plates (FIG. 2*a*), and the current density decreases about 5 times (FIG. 2*b*).

EXAMPLE 3

Figure 3:
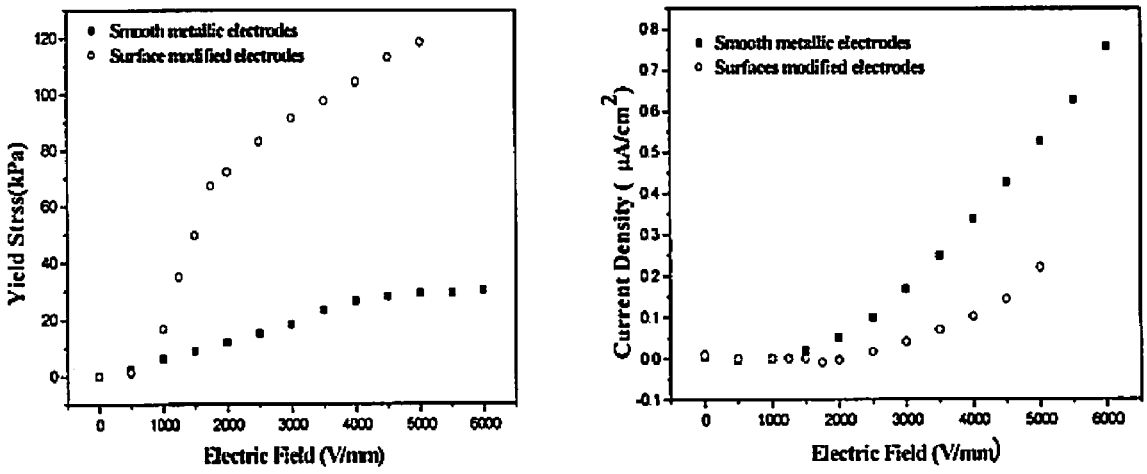
FIG. 3 shows the comparison of the electrorheological properties of an ER fluid with the modified electrodes fabricated by plating diamond grains on the surface of stainless steel plates and the smooth metallic electrodes.

The surfaces of the electrodes are modified by chemical and physical methods. Solid diamond grains having a particle size of 15 μm are adhered to the surfaces of the stainless steel plates with metallic nickel. The thickness of the modified layer is about 20 μm, and the diamond grains occupy 70% of the surface area of the metallic electrodes. The modified plates are used as the positive and negative electrodes of the parallel-plate rheometer to test the yield stress of the ER fluid of calcium titanate nanoparticles containing C═O and O—H groups as prepared in the Preparation Example 2. As shown in FIG. 3, the resulted yield stress is increased almost 4 times over that with smooth metallic aluminum plates (FIG. 3*a*), and the current density decreases about 3 times (FIG. 3*b*).

EXAMPLE 4

Figure 4:
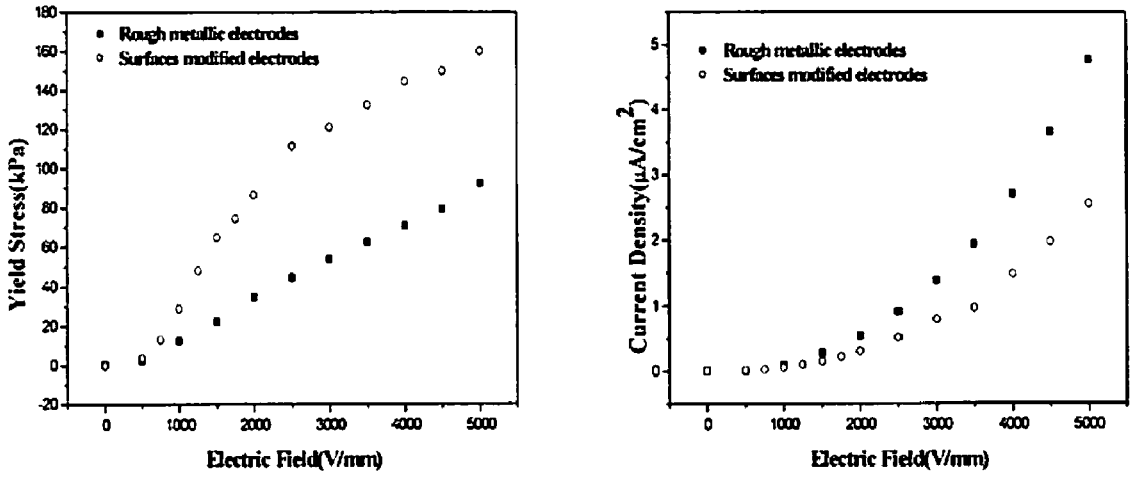
FIG. 4 shows the comparison of the electrorheological properties of an ER fluid with the modified electrodes fabricated by gluing grids on the surfaces of metallic plates and rough metallic electrodes.

The surfaces of the electrodes are modified by gluing grids. Nylon grids are adhered to the surface of the coppery electrode plates. The thickness of the grid is 0.4 mm, the grid width is 0.2 mm, the grid distance is 2 mm, and the nylon material occupies about 20% of the surface area of the metallic electrodes. The modified plates are used as the positive and negative electrodes of the parallel-plate rheometer to test the yield stress of the ER fluid of calcium titanate nanoparticles containing C═O and O—H groups as prepared in the Preparation Example 2. As shown in FIG. 4, the resulted yield stress is increased almost 1 time over that with rough surface metallic coppery plates (FIG. 4*a*), and the current density decreases about 50% (FIG. 4*b*).

EXAMPLE 5

Figure 5:
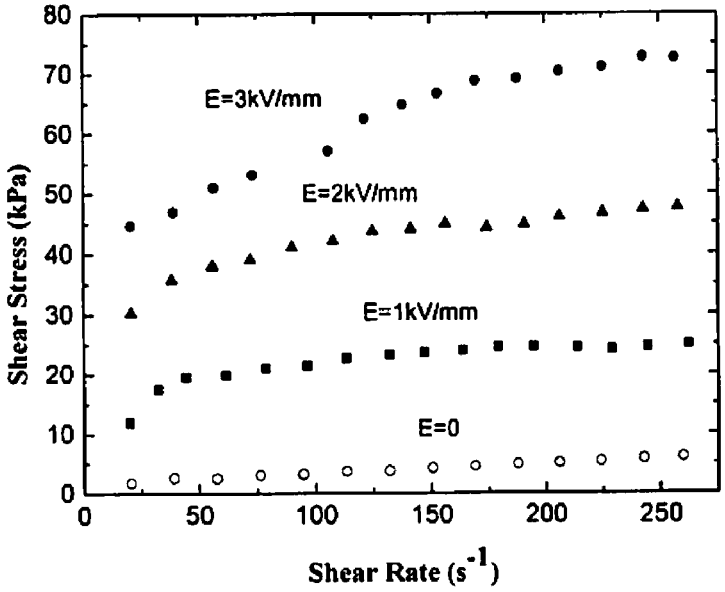
FIG. 5 shows the experimental results of the dynamic shear stress of a $TiO_2$ ER fluid.

The dynamic shear stress of the ER fluid is measured with a sealed cylindrical rheometer. The inner and outer surfaces of the cylinder are adhered with solid diamond grains (having a size of about 15 μm), the thickness is about 20 μm, and they occupy 60% of the surface area of the metallic electrodes. The modified plates as the electrodes of the sealed cylindrical rheometer are used to test the dynamic shear stress of the acetamide-doped titanium dioxide ER fluid as prepared in the Preparation Example 1, which is shown to solve the problem of slide of ER fluids on the electrodes. As shown in FIG. 5, the dynamic shear stress reaches 70 kPa at 3 kV/mm.

As shown in Examples 1-5, the surface modified electrode plate of the present invention increases the adhesion between the ER fluid and the electrode plates, which effectively overcome the "sliding" effect between high shear stress ER fluid and the electrode plate. By using the surface modified electrode plate of the present invention, the yield stress of the ER fluid as measured may be 1-5 times higher than that of ordinary metallic electrode plate, such that the measured shear stress of the ER fluid at the electrode plates is close to the intrinsic value. The dynamic shear stress measured by the surface modified electrode plate is very high and increases as the shear rate increases, which one would be impossible to obtain through ordinary metallic electrode plates. At the same time, the modified layer reduces the leakage current of the ER fluid object and increases the breakdown voltage of the ER fluid.

What is claimed is:

1. Surface modified electrode plates for ER fluids consisting essentially of metallic electrode plates having a surface in contact with ER fluids, and a modified layer that is added on the surface of the metallic electrode plates, wherein the modified layer is rough, wear-resisting, and low conductive; material of the modified layer is at least one selected from the group consisting of diamond, carborundum, titanium nitride, nylon, polytetrafluoroethylene, adhesive, and adhesive film; and the modified layer occupies about 10% to about 90% of the surface of the metallic electrode plates.

2. The surface modified electrode plates for ER fluids as claimed in claim 1, wherein the modified layer is added to the surface of the metallic electrode plates by mechanical processing, spraying, adhesive bonding, chemical depositing, plating, sintering, or infiltrating.

3. The surface modified electrode plates for ER fluids as claimed in claim 1, wherein the modified layer is in a form of regular particle, irregular particle, stripe, or grid.

4. The surface modified electrode plates for ER fluids as claimed in claim 3, wherein the modified layer is in the form of regular or irregular particles having a size of 100nm - 0.5mm.

5. The surface modified electrode plates for ER fluids as claimed in claim 4, wherein the modified layer is in the form of diamond grains that are added to the surface of the electrode plates.

6. The surface modified electrode plates for ER fluids as claimed in claim 1, wherein thickness of the modified layer is between 1 μm and 1mm.

7. Surface modified electrode plates for ER fluids comprising metallic electrode plates having a surface in contact with ER fluids, and a modified layer that is added on the surface of the metallic electrode plates, wherein the modified layer is rough, wear-resisting, and low conductive; material of the modified layer is at least one selected from the group consisting of diamond, carborundum, titanium nitride, nylon, polytetrafluoroethylene, adhesive, and adhesive film; and the modified layer occupies about 10% to about 90% of the surface of the metallic electrode plates, and wherein the modified layer is in a form of strips or grids, and distance of the strips or the grids is between 0.1-3mm.

8. An electrorheological (ER) fluid system comprising a polar molecule dominated ER fluid, wherein said ER fluid is turned into a solid-like state having a shear stress of more than 20 KPa under an electric field, and surface modified electrode plates comprising metal electrode plates having a surface in contact with said ER fluid and a modified layer that is added on the surface of the metal electrode plates, and wherein the modified layer is rough, wear-resisting, and low conductive; material of the modified layer is at least one selected from the group consisting of diamond, carborundum, titanium nitride, nylon, polytetrafluoroethylene, adhesive, and adhesive film; and the modified layer occupies about 10% to about 90% of the surface of the metallic electrode plates.

9. The ER fluid system of claim 8, wherein the modified layer on the surface modified electrode plates is in a form of regular particles, irregular particles, stripes, or grids.

10. The ER fluid system of claim 8, wherein the modified layer has a thickness of between 1 μm and 1mm.

11. Surface modified electrode plates for ER fluids comprising metallic electrode plates having a surface in contact with ER fluids, and a modified layer that is added on the surface, wherein the modified layer is rough, wear-resisting, and low conductive; material of the modified layer is alumina or titanium oxide; and the modified layer occupies about 10% to about 90% of the surface of the metallic electrode plates.

12. The surface modified electrode plates for ER fluids as claimed in claim 11, wherein the modified layer is in the form of regular or irregular particles.

13. The surface modified electrode plates for ER fluids as claimed in claim 12, wherein size of the particles is about 100 nm to 0.5 mm.

14. The surface modified electrode plates for ER fluids as claimed in claim 11, wherein the modified layer is applied to the surface by chemical bonding or spraying.

* * * * *